United States Patent [19]

Ross

[11] 4,004,721

[45] Jan. 25, 1977

[54] COLLAPSIBLE COAT HANGER

[76] Inventor: Jackson E. Ross, 4127 W. Cheery Lynn Road, Phoenix, Ariz. 85019

[22] Filed: May 17, 1976

[21] Appl. No.: 687,032

[52] U.S. Cl. ..... 223/89

[51] Int. Cl.[2] ..... A47J 51/10

[58] Field of Search ..... 223/88, 89, 90, 94; 211/113, 118

[56] References Cited

UNITED STATES PATENTS

| | | | |
|---|---|---|---|
| 1,114,294 | 10/1914 | Routstone | 223/89 |
| 2,232,028 | 2/1941 | Isaak | 223/88 |
| 2,354,099 | 7/1944 | Bess | 223/89 X |
| 2,488,219 | 11/1949 | Miller | 223/89 |

*Primary Examiner*—George H. Krizmanich
*Attorney, Agent, or Firm*—Cahill, Sutton & Thomas

[57] ABSTRACT

A full size coat hanger having a plurality of swivel connected telescoping units is collapsible into a pencil-like cylindrical configuration.

10 Claims, 9 Drawing Figures

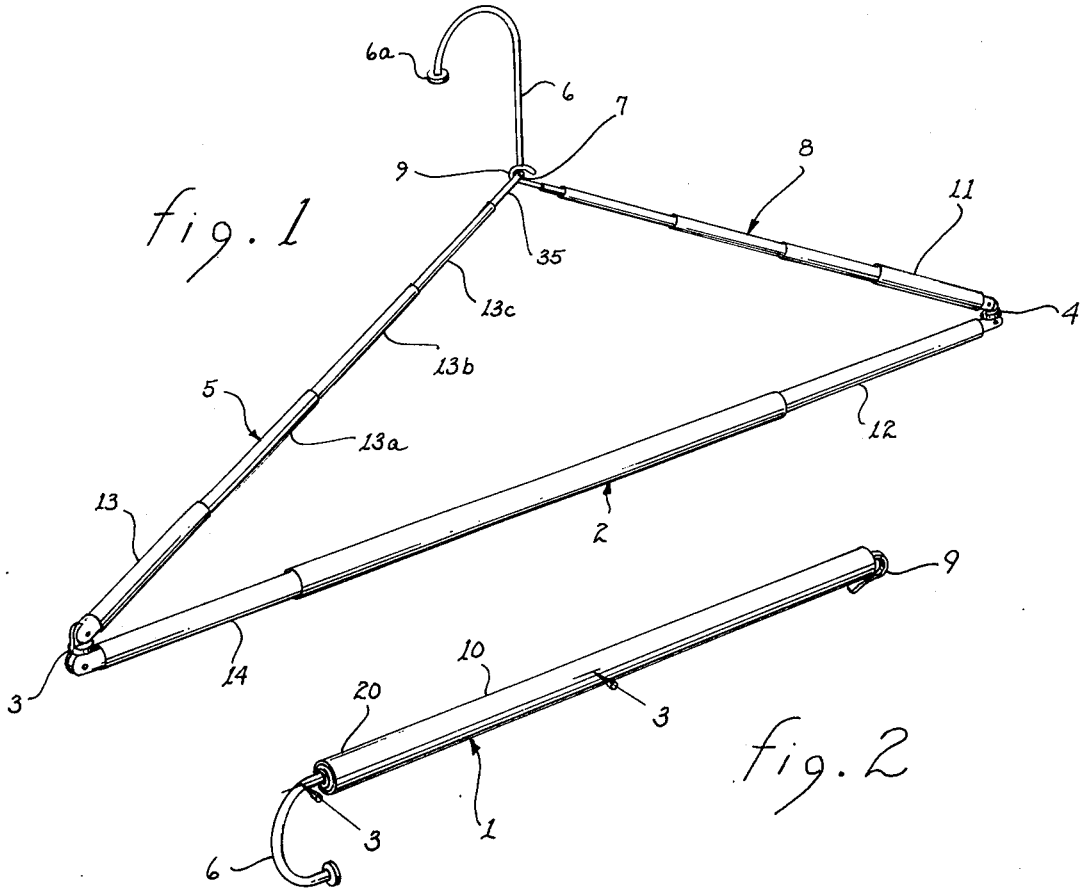
fig. 1
fig. 2
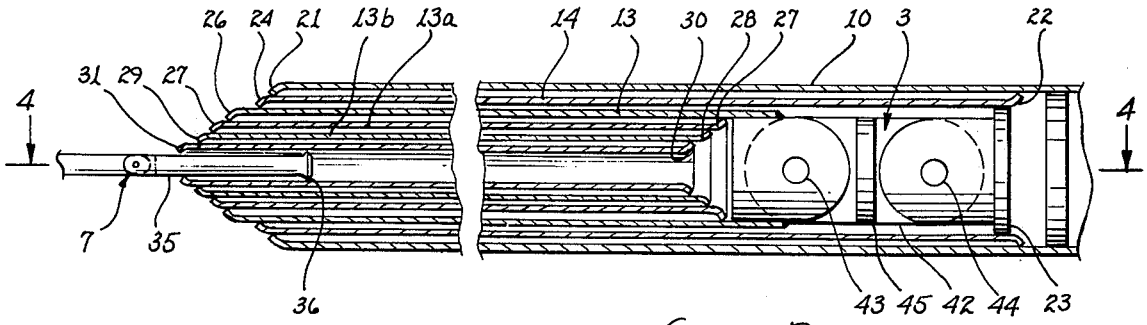
fig. 3
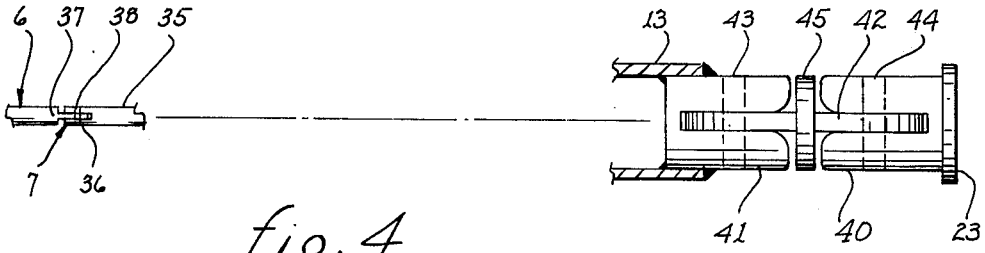
fig. 4

COLLAPSIBLE COAT HANGER

The present invention relates to collapsible coat hangers and, more particularly, to coat hangers which are telescopingly collapsible into a cylinder forming a part of the coat hanger.

Travel, for both business and pleasure purposes, has been on the increase for a number of years; particularly one and two day trips. When packing for short trips, it is convenient and preferable to minimize the quantity of clothes, toiletries and related items necessary for appearance and grooming purposes in order to avoid baggage handling and lost baggage problems. To maintain one's physical appearance, it is preferable that one's clothing be hung on hangers upon reaching one's destination. While most places for lodging do supply coat hangers, they are often flimsy or otherwise unsatisfactory in hanging the clothing properly. It is therefore prudent to transport sufficiently robust coat hangers along with the clothes to be hung thereon.

Coat hangers, of the standard type, are bulky and awkward to pack. Consequently, they are usually not included and one must suffer the consequences of rumpled clothing at one's destination should the place of lodging not provide adequate coat hangers.

During business trips and special social occasions when it is preferable to hang up one's coat when one is not wearing it and thereby avoid wrinkling, one must usually resort to draping it over the back of a chair or hanging it upon the hook of a hat rack. Again, a coat hanger which is readily and inconspicuously transportable for such occasions would be of consequential importance.

As tentative solutions to the above enumerated problems, several coat hangers have been developed. U.S. Pat. Nos. 1,114,002; 2,245,425; 1,284,811; 1,356,946; 2,613,858; and 2,663,470, describe variously configured coat hangers having telescoping extendible arms which reduce their bulk during storage and transportation. U.S. Pat. Nos. 1,193,356; 1,809,561 and 2,439,838, disclose coat hangers having articulated elements for reducing their bulk during non-use. U.S. Pat. Nos. 2,496,561; 3,188,675 and 3,874,572, show coat hangers having extendible arms. While these patents describe devices resulting from extensive developmental efforts to produce readily transportable coat hangers, certain deficiencies still exist from the standpoint of structural integrity and minimum size in the collapsed configuration.

It is therefore a primary object of the present invention to provide a robust coat hanger collapsible into a pencil-like cylindrical configuration.

Another object of the present invention is to provide a collapsible coat hanger having the rigidity of a triangular unit.

Yet another object of the present invention is to provide a coat hanger having two telescoping end units swivel connected to the extremities of a central telescoping unit.

Still another object of the present invention is to provide a coat hanger having three telescoping units collapsible into a housing forming a part of one of the units.

A further object of the present invention is to provide a robust coat hanger telescopingly extendible from a pencil-like configuration.

A yet further object of the present invention is to provide a collapsible rigid coat hanger having two interlocking arms swivel connected to a base.

A still further object of the present invention is to provide a collapsible coat hanger which may be transported within one's coat pocket in the manner of a pencil.

These and other objects of the present invention will become apparent to those skilled in the art as the description thereof proceeds.

The present invention may be described with greater specificity and clarity with reference to the following figures, in which:

FIG. 1 illustrates the collapsible coat hanger in its extended form.

FIG. 2 illustrates the collapsible coat hanger in its collapsed form.

FIG. 3 is a partial cross-sectional view taken along lines 3—3, as shown in FIG. 2.

FIG. 4 is a partial cross-sectional view of the swivel connections employed intermediate telescoping units of the collapsible coat hanger and taken along lines 4—4, as shown in FIG. 3.

Figure 5:
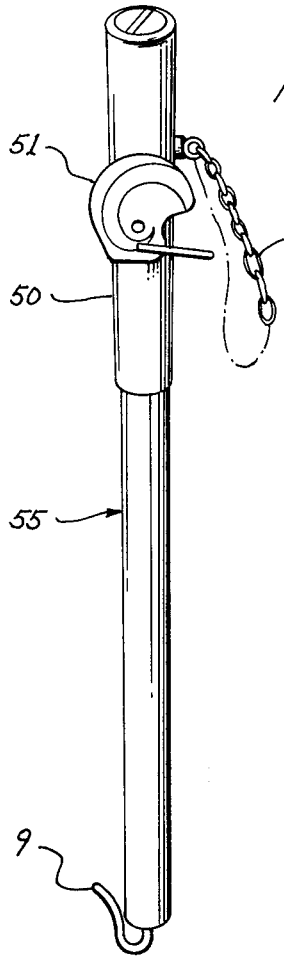
FIG. 5 illustrates a variant of the collapsed form of the collapsible coat hanger.

A collapsible coat hanger 1 constructed in accordance with the teachings of the present invention is illustrated in FIG. 1. A base member 2, having telescoping elements extending therefrom, is terminated at either end by one of dual acting swivels 3 and 4. One end of a telescoping arm 5 is pivotally connected to swivel 3; the other end of the arm is connected to a hook 6 through a pivot mechanism 7. Hook 6 may include an end plate **6*a* or similar means for aiding in retaining the hook upon a support. One end of another telescoping arm 8 is pivotally connected to swivel 4; a hook 9 extends from the other end of arm 8. Hook 9 is sized and configured to partially extend about and receivingly engage pivot mechanism 7**, whereby, the arms are interlockingly engageable.

The coat hanger is shown in its collapsed form in FIG. 2. Member 10, forming the central member of base 2, has a pencil-like cylindrical configuration and serves as the housing for the collapsed coat hanger. To effect collapse of the coat hanger, hook 9 is disengaged from about pivot mechanism 7 which permits arm 8 to pivot about swivel 4 until the arm is in general alignment with the longitudinal axis of member 10. The various cylindrical sections of arm 8 are telescopingly collapsed into cylindrical section 11 until only the ends of the cylindrical sections and hook 9 protrude therefrom. Simultaneously, or subsequently, cylindrical section 12 or a plurality of cylindrical sections extending intermediate member 10 and swivel 4 are telescopingly collapsed into the corresponding half of member 10. Swivel 4 is configured in cross-section to permit sliding interior to cylindrical section 12 and draw cylindrical section 11 and its contained sections thereinto. Similarly, the various cylindrical sections (**13*a*, 13*b*, 13*c* and 35) of arm 5** are telescopingly collapsed into cylindrical section 13 until only the ends of the cylindrical sections and hook 6 extend therefrom. Cylindrical section 14, or a plurality of cylindrical sections extending intermediate member 10 and swivel 3 are telescopingly collapsed into the corresponding half of member 10. Swivel 3 is configured to have a cross-sectional dimension which will permit its insertion within cylindrical section 14 and, upon insertion, draw cylindrical section 13 and its contained cylindrical sections into cylindrical section 14.

Upon full collapse of coat hanger 1, its appearance will be that illustrated in FIG. 2 wherein hook 9 extends from one end of member 10 and hook 6 extends from the other end. By having member 10 be pencil-like in length and diameter, the resulting collapsed coat hanger is readily and easily packed within any baggage, luggage or brief case.

Referring specifically to FIG. 3, the construction of the various telescoping sections will be described. One end 20 of member 10 is inwardly crimped by crimp 21 to lightly bear against the exterior surface of cylindrical section 14. Cylindrical section 14 includes a flange 22 disposed at one end thereof interior to member 10, which flange interferingly engages crimp 21 to preclude withdrawal of cylindrical section 14 from within member 10. The other end of cylindrical section 14 is crimped by a crimp 24. A plate 23 is disposed at one end of swivel 3 to bear against the interior surface of cylindrical section 14, which plate interferingly engages with crimp 24 to preclude complete withdrawal of swivel 3. One end of cylindrical section 13 circumscribes and is attached to the other end of swivel 3 to preclude disengagement therebetween. The other end of cylindrical section 13 is crimped by crimp 26, which bears against the exterior surface of cylindrical section 13*a* and interferingly engages flange 27 at one end of cylindrical section 13*b* to prevent complete withdrawal of cylindrical section 13*b*. The other end of cylindrical section 13*b* is crimped by crimp 29 to bear against the exterior surface of cylindrical section 13*c* and interferingly contact flange 30 at one end of cylindrical section 13*c* to preclude complete withdrawal of cylindrical section 13*c*. The other end of cylindrical section 13*c* is crimped by crimp 31 to bear against rod 35 of pivot 7. An annular flange 36 is disposed at the interior end of the rod for interferingly contacting crimp 31 and preclude withdrawal of the rod. While the above description particularly refers to arm 5 and the left hand part of base member 2 illustrated in FIG. 1, it is to be understood that arm 8 and the right hand side of base member 2 are of similar construction.

Swivels 3 and 4 and pivot mechanism 7 will be discussed with particular reference to FIGS. 3 and 4. Swivel 3 is developed from a pair of clevises 40 and 41 pivotally interconnected by a plate 42 secured in place by pivot pins 43 and 44. This construction permits the above discussed double action pivoting capability. The base of clevis 41 is inserted within and secured to one end of cylindrical section 13. Plate 23, which may be circular, is secured to the base of clevis 40. The diameter, or breadth of plate 23, is essentially equivalent to the internal diameter of cylindrical section 14 to permit sliding movement of the plate within the cylindrical section. A circular plate 45 is attached to plate 42 intermediate clevises 41 and 42 to aid in aligning the swivel during its insertion into cylindrical section 14.

Pivot mechanism 7 includes the clevis 36 extending from rod 35 for receiving end 37 of hook 6. A pivot pin 38 interconnects the clevis with end 37 to accommodate pivotal movement therebetween.

Figure 6:
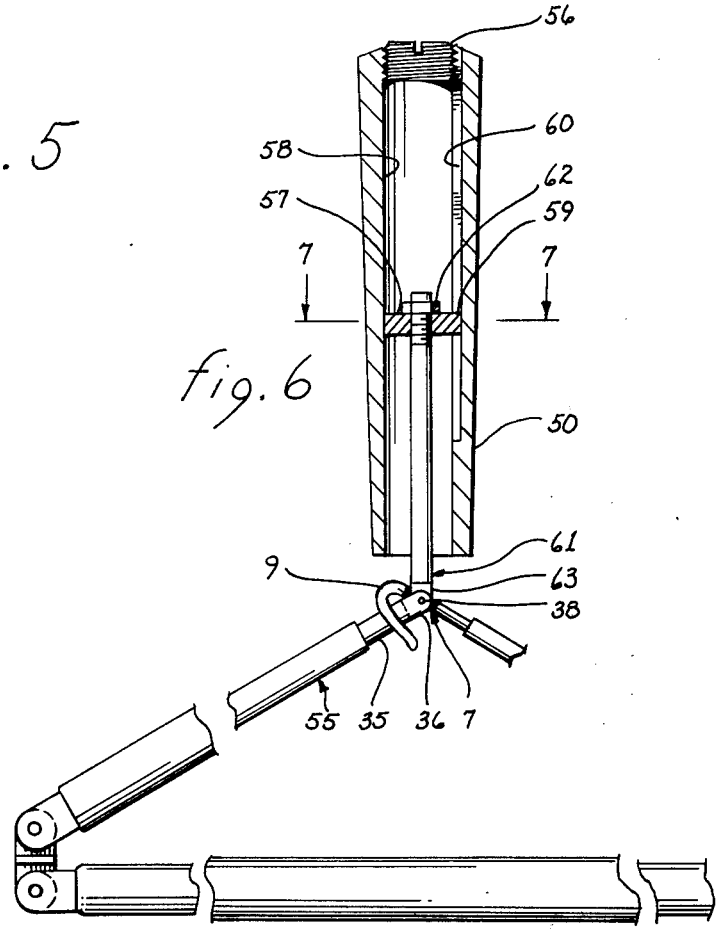
FIG. 6 is a partial view showing the variant of FIG. 5 in the extended form.
Figure 7:
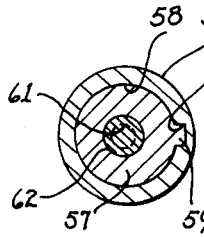
FIG. 7 is a cross-sectional view taken along lines 7—7, as shown in FIG. 6.

Referring to FIGS. 5, 6 and 7, there is illustrated a first variant of the present invention wherein hook 6 has been replaced by an ornamentally configured cap 50. The cap may include promotional devices, such as a silhouette of a football helmet 51, as illustrated. A chain 52 may be attached to cap 50 to permit supporting of the extended hanger from a peg or hook. The nomenclature of telescoping arms and base member described above with reference to FIGS. 1–4, are collectively referred to in FIGS. 5, 6 and 7 by the term hanger 55.

Cap 50 is a hollow tubular member having a threaded stopper 56 disposed at the upper end thereof. A circular plate 57 is longitudinally slidable within interior 58 of the cap. A key 59 extends lateral to plate 57 for engagement with the longitudinally oriented key way 60 disposed within the cap. The key and key way prevent rotation of plate 57 about the longitudinal axis of the cap while permitting rectilinear translation of the plate. A rod 61 is in threaded engagement with plate 57 and secured in place with a lock nut 62. The lower end of rod 61 extends external to the lower end of cap 50 and includes a plate 63 pivotally engaged with clevis 36 of rod 35 by pivot pin 38. In the alternative, a hook, such as hook 6 shown in FIG. 1, may be threadedly secured to the threaded extremity of rod 61. Thereby, upon the removal of cap 50 and substitution of hook 6, the variant shown in FIGS. 5 and 6 is useable as the embodiment shown in FIG. 1. As discussed above, hook 9 partially extends about pivot mechanism 7 to establish and maintain the interlocking rigid triangular orientation of hanger 55.

The variant illustrated in FIGS. 5–7 is particularly adapted for advertising purposes while simultaneously having a practical and utilitarian function.

Figure 8:
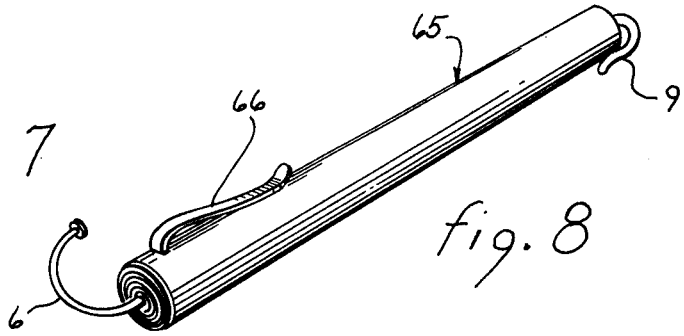
FIG. 8 is a further variant of the collapsed form of the collapsible coat hanger.
Figure 9:
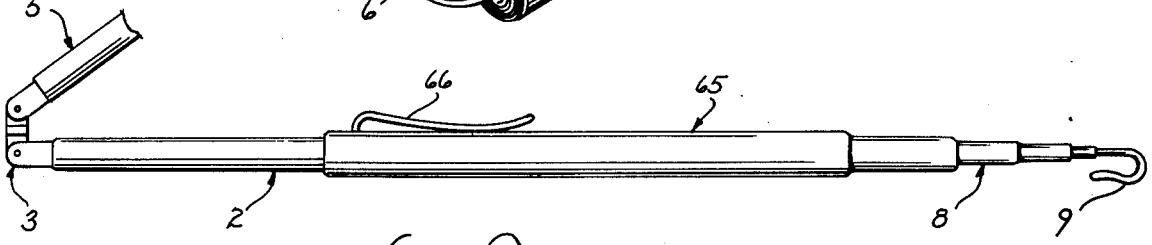
FIG. 9 is a partial view of the extended form of the variant shown in FIG. 8.

A further variant of the present invention is illustrated in FIGS. 8 and 9. When it would be expedient and convenient to carry a coat hanger upon one's person, the embodiment illustrated in FIG. 8 is of particular benefit. Herein, member 10 (see FIG. 1) is identified as member 65, which member has a clip 66 attached thereto. Clip 66 is of a type normally used for pens and pencils to retain them in one's breast pocket. Arms 5 and 8 and base member 2 of the hanger portion are essentially identical to that illustrated in FIG. 1.

In the collapsed configuration, as shown in FIG. 8, hook 9 would partially extend from the lower end of member 66. Similarly, hook 6 would extend from the upper or butt end of member 65. To avoid protrusion of hook 6, the latter may be articulated to accommodate insertion within member 65 or otherwise minimize protrusion of the hook from the butt end of the member. Necessarily, if hook 6 is articulated or otherwise collapsible, stops must be incorporated therein to render it functional as a hook for engaging a coat rack.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A collapsible coat hanger, said coat hanger comprising in combination:

a. a base member having a plurality of telescoping sections;

b. a first arm having a plurality of telescoping sections;

c. a first swivel for pivotally interconnecting one end of said base member with one end of said first arm;

d. means for suspending said coat hanger from a support, said suspending means being attached to another end of said first arm;

e. a second arm having a plurality of telescoping sections;

f. a second swivel for pivotally interconnecting another end of said base member with one end of said second arm;

g. hook means for interlocking another end of said second arm with said other end of said first arm to form a triangle of said base member and said first and second arms; and h. a housing forming a part of said base member for receiving the collapsed telescoping sections of said base member, the collapsed telescoping sections of said first and second arms and said first and second swivels;

whereby, said coat hanger is telescopingly collapsible into said housing of said base member.

2. The coat hanger as set forth in claim 1 wherein each said first and second swivels include two clevises pivotally attached to an interconnecting plate.

3. The coat hanger as set forth in claim 2 wherein one clevis of each said first and second swivel is fixedly attached to a telescoping section of a telescoping section of a respective one of said first and second arms.

4. The coat hanger as set forth in claim 3 wherein a plate is secured to the butt end of the other clevis of each of said first and second swivels for slidable engagement interior to a respective telescoping section of said base member.

5. The coat hanger as set forth in claim 4 wherein the cross-sectional dimension of said first and second swivels is less than the interior cross-section of said respective telescoping sections of said base member for accommodating respective slidable insertion of said first and second swivels therein.

6. The coat hanger as set forth in claim 5 wherein the telescoping sections of said base member and the telescoping sections of said first and second arms are cylindrical.

7. The coat hanger as set forth in claim 1 including a pivot mechanism disposed intermediate said suspending means and said other end of said first arm.

8. The coat hanger as set forth in claim 1 wherein said suspending means includes a cap for partially receiving said housing after collapse of said coat hanger.

9. The coat hanger as set forth in claim 8 wherein said cap includes slidable means for suspending said coat hanger in extended form from said cap.

10. The coat hanger as set forth in claim 10 wherein said housing includes a clip for securing said coat hanger in collapsed form to a supporting element.

* * * * *

UNITED STATES PATENT AND TRADEMARK OFFICE

CERTIFICATE OF CORRECTION

PATENT NO. : 4,004,721

DATED : January 25, 1977

INVENTOR(S) : Jackson E. Ross

It is certified that error appears in the above-identified patent and that said Letters Patent are hereby corrected as shown below:

In column 6, line 27, delete the second occurrence of "10" and substitute therefor --1--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*